US009437376B2

(12) United States Patent
Mattlar et al.

(10) Patent No.: US 9,437,376 B2
(45) Date of Patent: Sep. 6, 2016

(54) ELECTRIC CURRENT SWITCHING APPARATUS

(71) Applicant: ABB OY, Helsinki (FI)

(72) Inventors: Harri Mattlar, Iskmo (FI); Mikko Välivainio, Vaasa (FI)

(73) Assignee: ABB OY, Helsinki (FI)

( * ) Notice: Subject to any disclaimer, the term of this patent is extended or adjusted under 35 U.S.C. 154(b) by 0 days.

(21) Appl. No.: 14/512,155

(22) Filed: Oct. 10, 2014

(65) Prior Publication Data

US 2015/0027983 A1 Jan. 29, 2015

Related U.S. Application Data

(63) Continuation of application No. PCT/FI2013/050383, filed on Apr. 8, 2013.

(30) Foreign Application Priority Data

Apr. 12, 2012 (EP) ..... 12163956

(51) Int. Cl.
*H01H 9/44* (2006.01)
*H01H 9/36* (2006.01)
*H01H 73/04* (2006.01)

(52) U.S. Cl.
CPC ..... *H01H 9/443* (2013.01); *H01H 9/36* (2013.01); *H01H 9/362* (2013.01); *H01H 73/045* (2013.01); *H01H 2009/365* (2013.01)

(58) Field of Classification Search
CPC ..... H01H 33/66; H01H 9/30; H01H 33/34; H01H 33/38; H01H 9/443; H01H 33/182
USPC ..... 218/22, 46, 154; 335/78, 201
See application file for complete search history.

(56) References Cited

U.S. PATENT DOCUMENTS 2,749,410 A 6/1956 Weston
4,247,746 A 1/1981 Kidd
4,451,718 A * 5/1984 Yamagata ..... H01H 9/44 218/147

(Continued)

FOREIGN PATENT DOCUMENTS

CN 101542661 A 9/2009
EP 0 061 020 A1 9/1982

(Continued)

OTHER PUBLICATIONS

International Search Report (PCT/ISA/210) mailed on Jun. 17, 2013, by the Finnish Patent Office as the International Searching Authority for International Application No. PCT/FI2013/050383.

(Continued)

*Primary Examiner* — Truc Nguyen
(74) *Attorney, Agent, or Firm* — Taft Stettinius & Hollister LLP

(57) ABSTRACT

An electric switch includes a movable contact, a stationary contact to be contacted by the movable contact, one or more quenching plates, and a permanent magnet for directing an arc, which is formed when the contacts are separated from each other, to the quenching plate. The quenching plate has a base portion and side portions extending away from the base portion. The permanent magnet is arranged such that the arc is directed towards one of the side portions of the quenching plate.

15 Claims, 3 Drawing Sheets

(56) References Cited

U.S. PATENT DOCUMENTS

| | | | | |
|---|---|---|---|---|
| 4,910,485 | A | 3/1990 | Bolongeat-Mobleu et al. | |
| 5,296,827 | A * | 3/1994 | DiMarco | H01H 77/102 218/26 |
| 6,518,530 | B2 | 2/2003 | Heins et al. | |
| 6,639,168 | B1 | 10/2003 | Castonguay et al. | |
| 7,679,018 | B2 | 3/2010 | Kolmonen et al. | |
| 7,728,247 | B2 | 6/2010 | Pikkala et al. | |
| 8,334,740 | B2 * | 12/2012 | Annis | H01H 9/446 218/148 |
| 8,937,519 | B2 * | 1/2015 | Gerving | H01H 1/20 335/132 |
| 2002/0056705 | A1 | 5/2002 | Heins et al. | |
| 2005/0083155 | A1 * | 4/2005 | Attarian | G01R 15/183 335/18 |
| 2007/0085638 | A1 * | 4/2007 | Zindler | 335/132 |
| 2007/0145016 | A1 | 6/2007 | Pikkala et al. | |
| 2008/0035464 | A1 | 2/2008 | Kolmonen et al. | |
| 2008/0067153 | A1 * | 3/2008 | Pollitt et al. | 218/154 |
| 2008/0074216 | A1 * | 3/2008 | Annis et al. | 335/201 |
| 2009/0120908 | A1 | 5/2009 | Domejean | |
| 2010/0126966 | A1 | 5/2010 | Domejean et al. | |
| 2012/0313737 | A1 * | 12/2012 | Iwamoto | H01H 50/56 335/185 |
| 2015/0114934 | A1 * | 4/2015 | Juds | H01H 33/08 218/149 |
| 2015/0194284 | A1 * | 7/2015 | Uruma | H01H 1/06 335/179 |

FOREIGN PATENT DOCUMENTS

| | | | |
|---|---|---|---|
| EP | 0 874 380 | A1 | 10/1998 |
| EP | 1 667 179 | A2 | 6/2006 |
| WO | WO 92/00598 | A1 | 1/1992 |

OTHER PUBLICATIONS

International Search Report (PCT/ISA/210) mailed on Jun. 18, 2013, by the Finnish Patent Office as the International Searching Authority for International Application No. PCT/FI2013/050384.

International Search Report (PCT/ISA/210) mailed on May 16, 2013, by the Finnish Patent Office as the International Searching Authority for International Application No. PCT/FI2013/050385.

Oct. 9, 2015 Chinese Office Action issued in Chinese Application No. 2013800193648 (English language translation).

Sep. 20, 2012 extended European Search Report issued in European Application No. 12163956.1.

* cited by examiner

ELECTRIC CURRENT SWITCHING APPARATUS

RELATED APPLICATIONS

This application claims priority as a continuation application under 35 U.S.C. §120 to PCT/FI2013/050383, which was filed as an International Application on April 8, 2013 designating the U.S., and which claims priority to European Application 120163956.2 filed in Europe on Apr. 12, 2012. The entire contents of these applications are hereby incorporated by reference in their entireties.

FIELD

The present disclosure relates to an electric current switching apparatus.

BACKGROUND INFORMATION

A known issue associated with opening a DC current is that an arc builds between the contacts of the switch when the contacts are separated from each other. The arc is erosive and may thus damage nearby parts of the switch.

There have been attempts to use a magnetic field, produced by permanent magnets or a coil placed in proximity of the contacts, to blow the arc away to quenching plates. Often the case is that currents close to the nominal current are easier to switch than currents that are small compared to the nominal current. This is because an arc associated with a nominal current seeks to the quenching plates but an arc with low current more easily remains to burn between the contacts of the switch.

However, known techniques for quenching an arc in the switches are either complicated or do not fully meet the demand for durability of the switch.

SUMMARY

An exemplary embodiment of the present disclosure provides an electric switch which includes a movable contact, a stationary contact for being contacted by the movable contact, one or more quenching plates, and a permanent magnet for directing an arc, which is formed when the contacts are separated from each other, to the quenching plates. The quenching plate has a base portion and side portions extending from the base portion, and the permanent magnet is placed closest to the base of the quenching plate such that the side portions extending from the base of the plate extend away from the permanent magnet. The permanent magnet is arranged to direct the arc towards one of the side portions of the quenching plates.

BRIEF DESCRIPTION OF THE DRAWINGS

In the following, disclosed features of the present disclosure will be described in greater detail by way of exemplary embodiments, with reference to the accompanying drawings, in which.

DETAILED DESCRIPTION

Exemplary embodiments of the present disclosure provide a switch which can alleviate issues associated with known techniques.

Exemplary embodiments of the present disclosure provide an electric switch for switching electric current. The switch of the present disclosure may be applied in various areas, such as electric motors and solar systems, for example.

In accordance with an exemplary embodiment of the switch according to the present disclosure, there is provided an arc chamber for quenching an arc caused by separating the contacts of the switch. The arc chamber houses a plurality of quenching plates, and there is provided a permanent magnet for blowing the arc towards the plates.

In accordance with an exemplary embodiment, the quenching plates have a bottom portion and side portions extending from the bottom portion. The permanent magnet may be arranged such that the arc is directed towards one of the side portions of the plates.

The switch of the present disclosure is easy to mount and is effective in quenching the arc caused by the separation of switch contacts.

Figure 1:
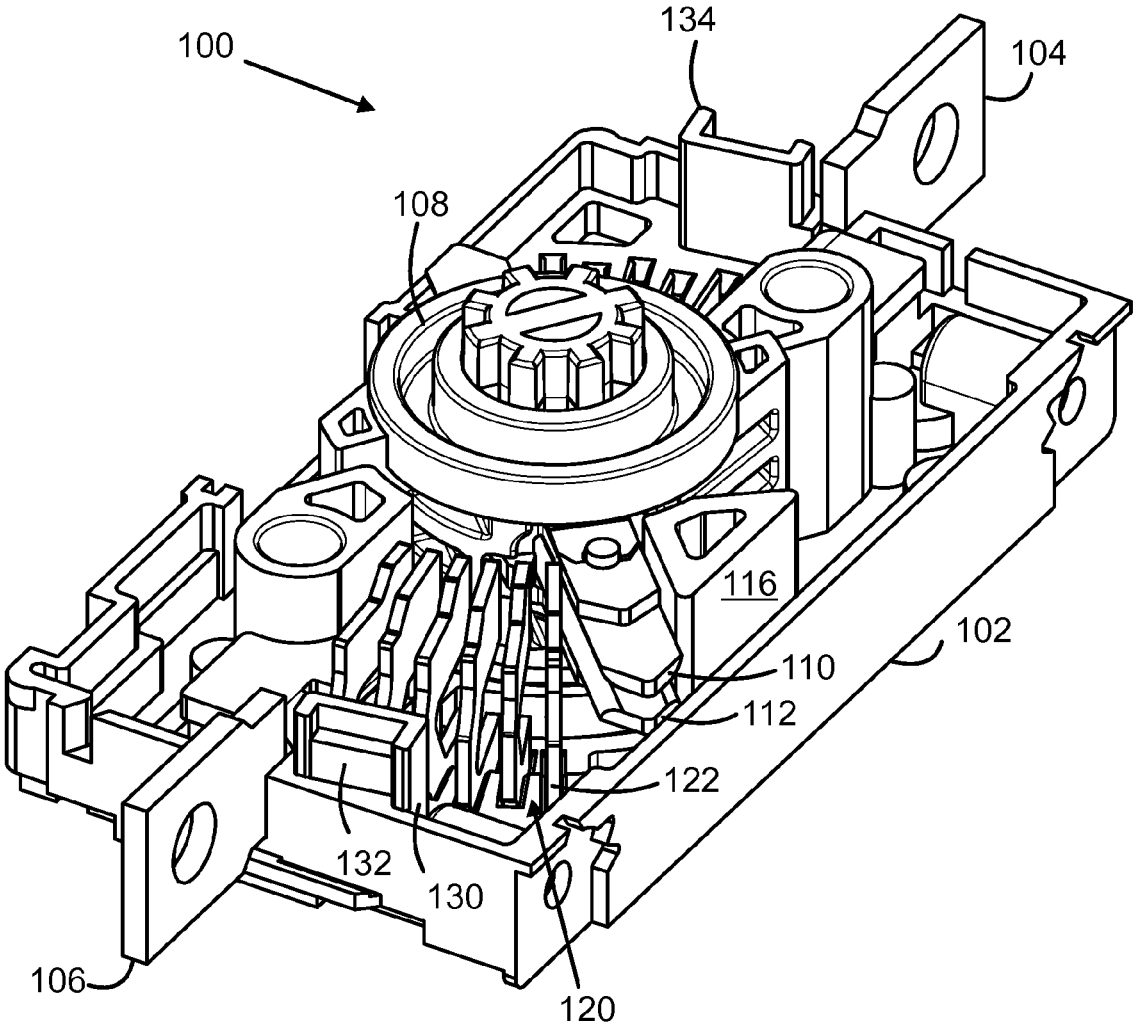
FIG. 1 shows a view of an exemplary embodiment of a switch.

FIG. 1 shows an exemplary embodiment of a single-pole electric switch 100 without a top cover. The switch has an electrically insulating module housing 102, and by stacking such modules together, multi-pole switches can be constructed.

At the ends of the switch, there are stationary contacts 104, 106 for connecting the switch to power terminals. A movable/rotary contact 108 may include contact arms 110, 112, between which a contact portion of the stationary contact 106 fits when the contact is made. The contact arms of the rotary contact may have a form of a lengthy knife, for instance.

FIG. 1 shows the switch in the open position, where the contact arms 110, 112 of the movable contact are not in contact with the stationary contact but rest against a stoppage element 116, according to an exemplary embodiment of the present disclosure.

The switch also includes an arc chamber 120 for quenching an arc caused by separating the contacts from each other. The arc chamber houses a plurality of quenching plates 122 via which the contact arms 110, 112 of the movable contact move when the switch is opened. As the figure shows, the quenching plates are arranged to the arc chamber next to each to each other such that they are arranged a distance away from the contact area of the rotary contact and the stationary contact. That is, the second quenching plate lies further away from the contact area than the first quenching plate.

There is also provided a permanent magnet 132, which is placed into a housing 130 for the magnet. The housing residing in the first switch module housing 100 may include a wall portion that is provided between the magnet and the contact area and the plates. There also may be provided also side portions extending perpendicularly from the wall portion. According to an exemplary embodiment, the purpose of the wall portion and the side portion is to keep the magnet in its place thereby resisting the traction between the magnet and the plates, and protecting the magnet from the erosive effects of the arc. A second switch module housing to be mounted to the first switch module housing 100 may include a support portion, which supports the magnet in housing 130 and further protects it from the arc.

The position of the housing is behind the quenching plates, and at the beginning of the arc chamber when seen from the stationary contact point of view. According to an exemplary embodiment, the permanent magnet is positioned such that it is behind one or more such plates that lie closest to the contact area. In the exemplary embodiment of FIG. 1, the magnet lies behind substantially the first half of the quenching plates. In this way, sufficient blowing effect can be caused to the arc immediately when the arc builds up to push it towards one of the side portions of the plates. In FIG. 1, the arc is thus blown towards the side of the plates that is arranged against the bottom of the housing, or towards the opposite side of the plates, depending on which way the current is arranged.

Figure 2:
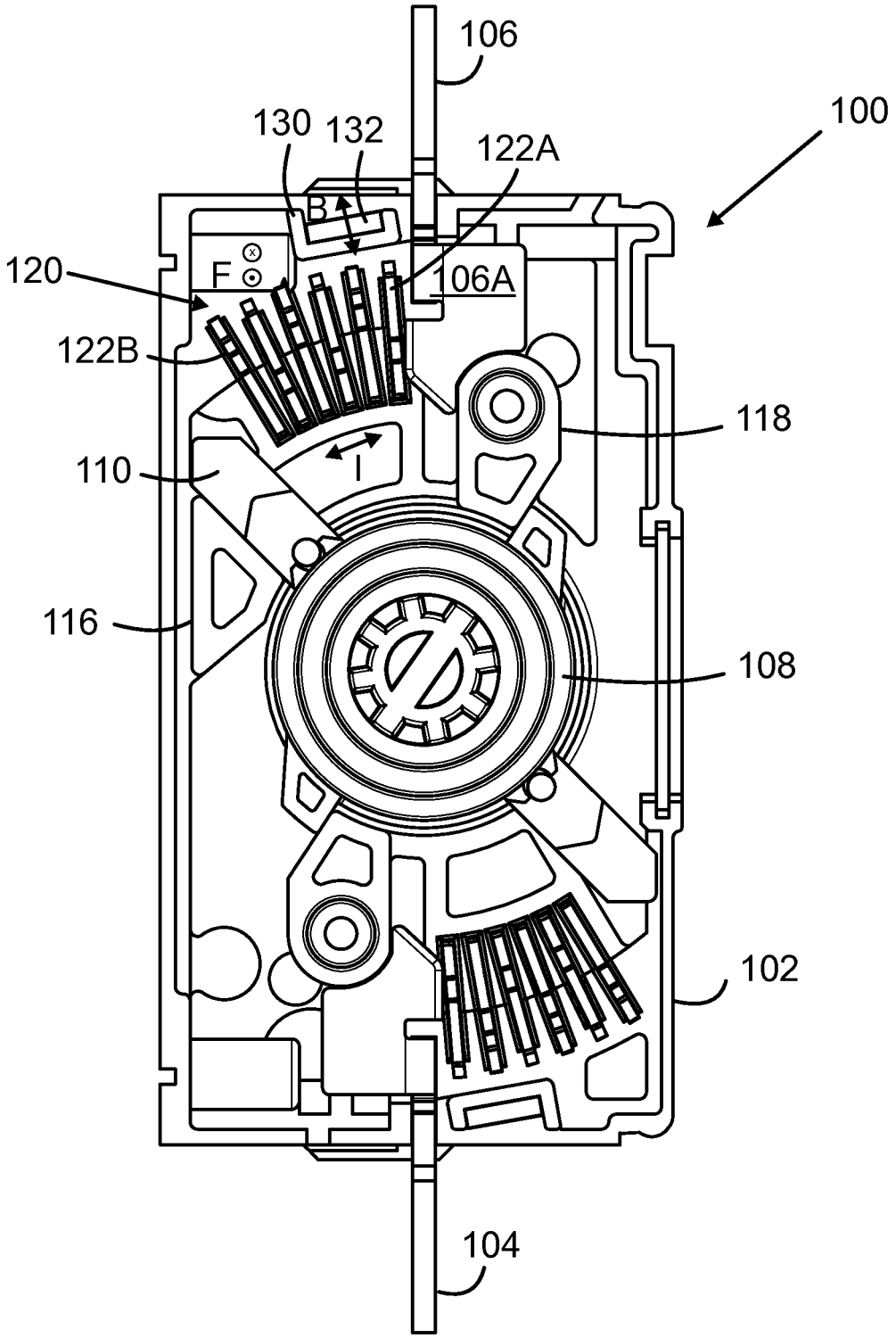
FIG. 2 shows another view of an exemplary embodiment of the switch of FIG. 1.

FIG. 2 shows the switch 100 of FIG. 1 seen from the top, according to an exemplary embodiment.

It can be seen that the stationary contact 106 has a plane-like contact portion 106A to be contacted by the contact arm 110 of the movable contact. When the movable contact arm 110 is in contact with the stationary contact 106A, the arm rests substantially against the stoppage element 118.

In the exemplary embodiment of FIG. 2, there are six quenching plates placed to the arc chamber 120 such that there are small intervals between the plates. The first quenching plate 122A is in immediate proximity, or even in contact, of the stationary contact 106A, and the last plate 122B may be arranged such that the arm 110 is not in the area of plates when the movable contact is in its open position.

According to an exemplary embodiment, the quenching plates have a base/bottom portion and two side portions extending from the base portion, that is, the base portion connects the side portions. The side portions may be arranged substantially parallel to each other. An example of such a form is a letter U form. In FIG. 2, the base of the quenching plates 122A, 122B points towards the end of the switch having the stationary contact 106, that is, the base points substantially towards the magnet 132. The plate is thus arranged such that the base resides thus between the magnet 132 and the quenching area of the plate, which is the area between the side portions of the plate. In the viewing angle of FIG. 2, mainly the top side portions of the plates are visible to the top.

According to an exemplary embodiment, the permanent magnet 132 may have a rectangular cross-section in the horizontal direction as shown in FIG. 2. In the vertical direction, the cross-section of the magnet may be a square or rectangle, for instance. The poles of the magnet are arranged such that magnetic field B of the magnet is directed in the horizontal plane, which is highlighted by the two-headed arrow. The direction of the magnetic field between the two alternatives depends on which way the permanent magnet is placed to the housing 130. In either direction, the magnetic field is substantially parallel to the principal directions of the side portions, and perpendicular to the base portion of the plates. The magnetic field is thus substantially parallel to the longitudinal direction of the rotary contact at the point of rotation of the rotary contact when it separates from the stationary contact, which is the point where the arc builds up.

The square cross-section form of the permanent magnet and the housing is advantageous as the magnet can be mounted to the housing in any position and the magnetic field B is directed in one of the directions shown in FIG. 2. If the permanent magnet has a square form, there are eight available mounting positions for the magnet. The person doing the assembly can mount the magnet to the magnet housing in any of the eight positions, and the magnet field produced by the magnet is one of the alternatives shown in FIG. 2.

According to an exemplary embodiment, the permanent magnet may be a small-sized magnet. For example, the dimensions of the magnet are 1 cm*1 cm*2 mm. With such a small-sized magnet, special advantages are achieved when quenching small currents compared to the nominal current.

If the cross-section of the magnet on the side that faces the quenching plates is rectangular, there are four available mounting positions. According to an exemplary embodiment, there are also other forms that could be used, such as square or triangular. In the case of a triangular magnet, there are six mounting positions, and in the case of a square, there are two alternative mounting positions.

The form of the magnet housing and the magnet are such that the magnet housing forces the person doing the assembly to place the magnet into the housing in a position that is acceptable and results the magnetic field to be created in a desired way. Thus, any mounting position the user chooses is acceptable and allowable. The mounting direction of the magnet thereby need not be indicated in any way.

FIG. 2 also shows alternatives for the direction of the current I in the arc when the switch is opened. The direction of the current can thus vary between the two alternatives depending on which way the stationary contacts are mounted to the power supply.

According to the Lorentz force law, the force F acting on a point charge is directed in vertical direction in the situation of FIG. 2 depending on the direction of the magnetic field B and the current I. That is, the force F acting on the arc blows the arc towards one of the side portions of the quenching plates.

Figure 3:
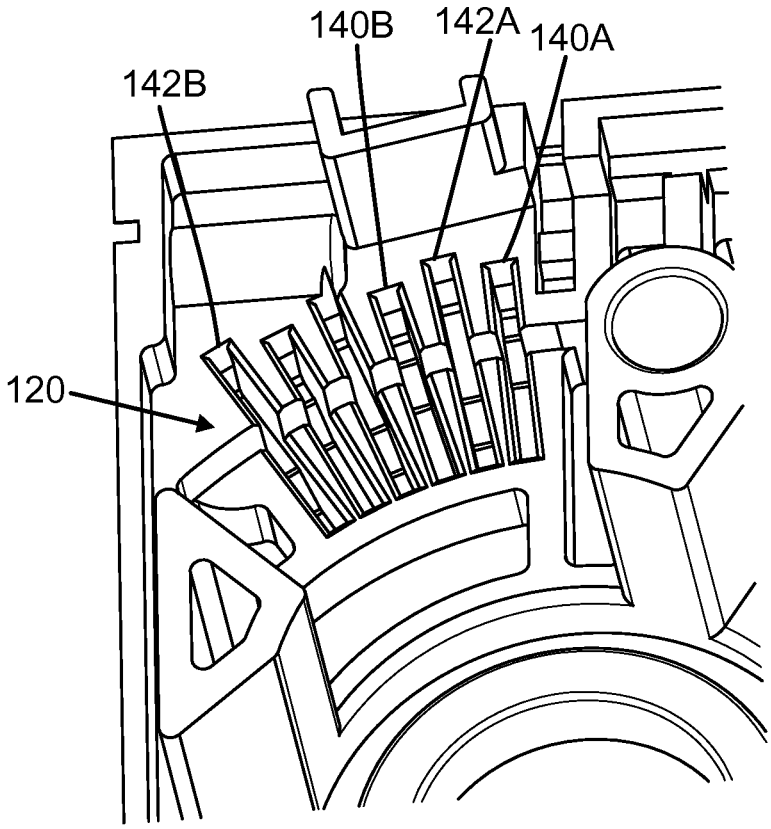
FIG. 3 highlights an arc chamber according to an exemplary embodiment of the present disclosure.

FIG. 3 further highlights the structure of the arc chamber 120, according to an exemplary embodiment of the present disclosure. In the arc chamber, there are six slots/recesses 140, 142 for receiving respective quenching plates. The number of slots and plates is not limited to six but can vary depending on the size of the switch and other design factors.

In accordance with an exemplary embodiment, there are two types of slots. The odd numbered slots 140A, 140B, that is the first, third and fifth slots are similar. Correspondingly, the even numbered slots 142A, 142B, that is the second, fourth and sixth slots are mutually similar. The quenching plates are formed such that the outer edge of the first side portion, that is, the first mounting portion, of the plate is suitable to for mounting to the odd numbered slots, and the edge of the other side portion, that is the second mounting portion, is suitable for mounting to the even numbered slots. Thereby, the form of the slots and the plates force that the plates are mounted to the slots in a correct way. If the plates are not mounted correctly to the slots, the plates may prevent mounting of the first and second switch module housings together.

The illustrated exemplary embodiment is not limited to there being only two different types of recesses in the switch, as there can be a greater number of different types of recesses. However, also in such a case, the form of the recess is such that it forces the quenching plate to be assembled in a correct position to the switch.

FIG. 3 shows the bottom housing module 120 of a switch module, according to an exemplary embodiment of the present disclosure. There is also provided a top housing module for the switch module. The top housing may have similar slots for receiving the quenching plates; however, they are in an inverse order compared to the slots in the bottom housing. That is, a slot of a first type in the bottom housing is opposite to a slot of second type in the top housing module. Thereby also the top housing ensures that the quenching plates are mounted to the switch in correct position.

Figure 4A:
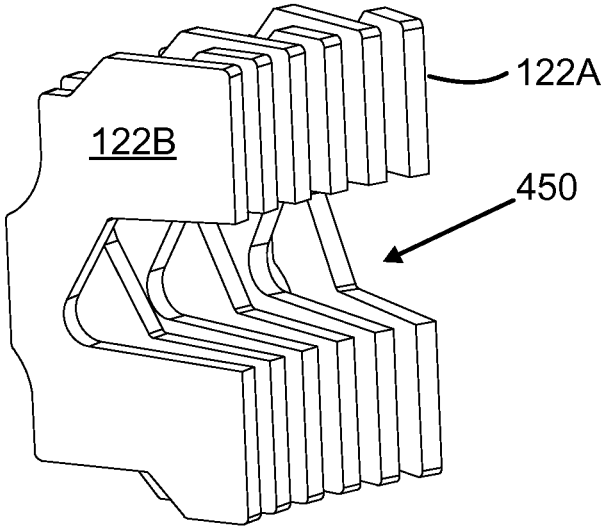
FIG. 4A shows a group of quenching plates according to an exemplary embodiment of the present disclosure.
Figure 4B:
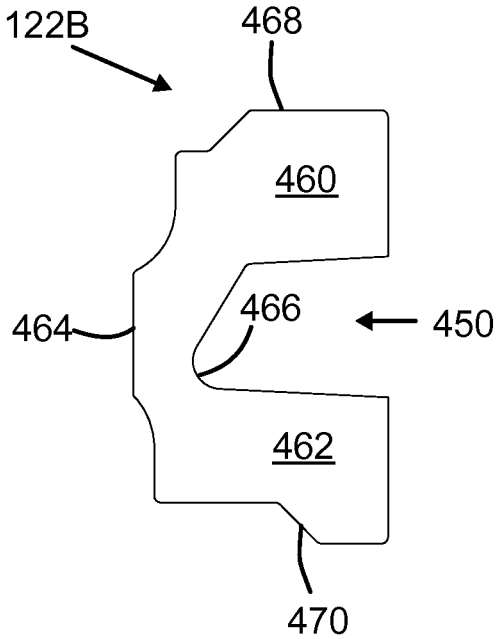
FIG. 4B shows one quenching plate from the side, according to an exemplary embodiment of the present disclosure.

FIG. 4A further illustrates a group of quenching plates. and FIG. 4B shows one plate from the side, according to an exemplary embodiment of the present disclosure.

In FIG. 4A, all the plates are similar but they are arranged alternately such that each other plate is flipped 180 degrees. However, the plates are asymmetric in view of a middle line of the plate. The asymmetry shows inside of the plate where a propagation channel 450 for the arc is formed. The asymmetry also shows on the outside of the plates, especially on the edges of the plates including a first mounting portion 468 and second mounting portion 470 for mounting the plate to respective recesses in the switch. When, in a group of plates, each other plate is flipped 180 degrees, the propagation channel 450 for the arc between the side portions of the plates becomes non-continuous or non-uniform. The form of the channel changes at each plate of the group of plates. Thereby the propagation path length can be increased, which effectively causes quenching of the arc.

As can be seen from FIG. 4B, the quenching plate 122B is substantially U-shaped, having a base/bottom portion 464 and two side portions 460, 462 extending from the base portion. In the exemplary embodiment of FIG. 4B, the base portion 464 may include a vertical portion, and the side portions may include horizontal portions, that is they are arranged perpendicularly to each other. It can be seen that the two side portions 468, 470 are substantially parallel with respect to each other. Between the side portions, a propagation channel 450 is formed for the arc.

As the figure shows, the top and bottom halves of the plate are asymmetric in view of a horizontal middle line. Within the propagation channel, a propagation bottom 466 may be provided in the lower half of the plate, which propagation bottom is closest to the base 464. The propagation bottom thus lies aside from the middle of the plate thereby causing the propagation channel to become non-uniform when similar plates are mounted alternately to the switch. According to an exemplary embodiment of the present disclosure, the arc seeks the furthest point in the plate, and the purpose of the propagation bottom is to maximize the length and to give variety to the form of the arc propagation path. In the neighbouring plate, as the plate is 180 degrees flipped to plate 122B, the propagation bottom would be in the higher half of the plate.

It can also be seen that the mounting portions, that is the upper edge 468 and lower edge 470 are mutually different from each other. In this manner, the plate 122B can be mounted to either of the slots 140A or 142A depending on which mounting portion is used.

It will be obvious to a person skilled in the art that, as the technology advances, the inventive concept can be implemented in various ways. The invention and its embodiments are not limited to the examples described above but may vary within the scope of the claims.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. An electric switch, comprising:

a movable contact;

a stationary contact for being contacted by the movable contact;

at least one quenching plate; and a permanent magnet for directing an arc, which is formed when the contacts are separated from each other, to the at least one quenching plate, wherein the at least one quenching plate has a base portion and side portions extending from the base portion, and the permanent magnet is placed closest to the base portion of the at least one quenching plate such that the side portions extending from the base portion of the at least one quenching plate extend away from the permanent magnet in a direction opposite to the permanent magnet, wherein the permanent magnet is arranged behind the at least one quenching plate such that the base portion of the at least one quenching plate resides between the permanent magnet and a quenching area of the at least one quenching plate, the quenching area being defined between the side portions of the at least one quenching plate, and wherein the permanent magnet is arranged to direct the arc towards one of the side portions of the at least one quenching plate.

2. An electric switch according to claim 1, comprising:

a magnet housing for receiving the permanent magnet, the magnet housing allowing mounting of the permanent magnet only in a position where the arc is directed towards one of the side portions of the at least one quenching plate.

3. An electric switch according to claim 2, wherein when the permanent magnet is mounted to the magnet housing, a magnetic field produced by the permanent magnet is substantially parallel to a longitudinal direction of the movable contact at a point of rotation of the movable contact when it separates from the stationary contact.

4. An electric switch according to claim 2, wherein the magnet housing comprises a wall portion between the permanent magnet and the at least one quenching plate.

5. An electric switch according to claim 2, comprising:

a first housing module and a second housing module, each of the first and second housing modules comprising part of the magnet housing, which is formed when the first housing module and the second housing module are assembled together.

6. An electric switch according to claim 1, wherein the permanent magnet is arranged in proximity to a contact area of the movable contact and the stationary contact.

7. An electric switch according to claim 1, wherein the permanent magnet has a side having one of a square, rectangular, triangular and round cross-section.

8. An electric switch according to claim 1, wherein a dimension of a first side the permanent magnet is greater in a first dimension than a dimension of a second side in a second dimension perpendicular to the first side, and wherein a magnetic field produced by the permanent magnet is arranged such that it is parallel to the direction of the second side having the smaller dimension.

9. An electric switch according to claim 1, comprising:

an arc chamber housing the at least one quenching plate arranged next to each other, wherein the permanent magnet is arranged behind one or more of the at least one quenching plate which lie closest to a contact area of the movable contact and the stationary contact.

10. An electric switch according to claim 1, wherein the at least one quenching plate has a form substantially of the letter U.

11. An electric switch according to claim 1, comprising: a plurality of the quenching plates, wherein the quenching plates are similar to each other, each plate respectively having a first half and a second half having a different form than the first half.

12. An electric switch according to claim 11, wherein the quenching plates are arranged alternately to the switch such that in two neighboring plates, the first half of a first one of the plates and the second half of a second one of the plates are adjacent to each other.

13. An electric switch according to claim 1, comprising: a plurality of the quenching plates, wherein at least one of the quenching plates has a first mounting portion and a second mounting portion of the respective side portions, wherein the mounting portions of the first side portion and the second side portion are different from each other.

14. An electric switch according to claim 13, wherein each of the first housing module and the second housing module have recesses for receiving the quenching plates, the recesses in the first housing module and the second housing module being arranged such that, opposite to a recess for receiving the first mounting portion of the quenching plate of the first housing module is a recess for receiving the second mounting portion of the same quenching plate in the second housing module.

15. An electric switch according to claim 1, wherein the base portion extends in a first direction and connects the side portions extending from the base portion, the side portions extending away from the base portion in a second direction orthogonal to the first direction, and wherein the base portion is arranged between the permanent magnet and the side portions such that the permanent magnet is positioned behind the base portion in the second direction and the side portions extend away from the permanent magnet in the second direction opposite to the permanent magnet.

* * * * *